US007096837B2

(12) United States Patent
Kieninger et al.

(10) Patent No.: US 7,096,837 B2
(45) Date of Patent: Aug. 29, 2006

(54) VALVE TRAIN OF AN INTERNAL COMBUSTION ENGINE

(75) Inventors: Stefan Kieninger, Jandelsbrunn (DE); Eric Berndt, Whitefish Bay, WI (US)

(73) Assignee: Ina Schaeffler KG, (DE)

( * ) Notice: Subject to any disclaimer, the term of this patent is extended or adjusted under 35 U.S.C. 154(b) by 43 days.

(21) Appl. No.: 11/061,328

(22) Filed: Feb. 18, 2005

(65) Prior Publication Data

US 2005/0183685 A1 Aug. 25, 2005

Related U.S. Application Data

(60) Provisional application No. 60/546,320, filed on Feb. 20, 2004.

(51) Int. Cl.
*F01L 1/18* (2006.01)

(52) U.S. Cl. ..... 123/90.44; 123/90.16; 123/90.27; 74/569

(58) Field of Classification Search ..... 123/90.16, 123/90.27, 90.31, 90.6, 90.39, 90.44; 29/888.1; 74/567, 569
See application file for complete search history.

(56) References Cited

U.S. PATENT DOCUMENTS 5,398,648 A * 3/1995 Spath et al. ..... 123/90.16

* cited by examiner

*Primary Examiner*—Thomas Denion
*Assistant Examiner*—Ching Chang
(74) *Attorney, Agent, or Firm*—Charles A. Muserlian

(57) ABSTRACT

The invention proposes a valve train of an internal combustion engine comprising a cam (1) and a directly driven cam follower (2), such as a roller tappet. This valve train is additionally designed for effecting an internal exhaust gas recirculation at an exhaust valve. A housing (4) of the cam follower (2) comprises two relatively displaceable elements (8, 9). The cam (1) is configured as a high lift cam (1*a*) for the inner element (8), and at least one low lift cam (1*b*) configured out-of-phase to the high lift cam (1*a*) is provided for the outer element (9). When it is desired to carry out an internal exhaust gas recirculation, the two elements (8, 9) are coupled to each other by a coupling element (10), so that, at the end of the base circle of the high lift cam (1*a*), the low lift cam (1*b*) protruding thereinto enables a slight post-opening of the gas exchange valve concerned and, thus also, an exhaust gas recirculation.

7 Claims, 1 Drawing Sheet

VALVE TRAIN OF AN INTERNAL COMBUSTION ENGINE

FIELD OF THE INVENTION

This application is a based on U.S. Provisional Application Ser. No. 60/546,320 filed Feb. 20, 2004.

The invention concerns a valve train of an internal combustion engine comprising at least one cam and one directly driven cam follower, typically a roller or cup tappet, said cam follower comprising on one front end of a housing, a direct running surface for the cam, and on a further front end, an at least indirectly actuating surface for at least one gas exchange valve.

BACKGROUND OF THE INVENTION

Valve trains of the pre-cited type are sufficiently well-known in the technical field and need no further detailed description here. An internal exhaust gas recirculation within narrow limits takes place due to valve overlap. For example, the quantity of exhaust gas returned to the combustion chamber by the exhaust gas system is determined by the point of time of closing of the exhaust valve. This can lead to advantages with regard to consumption and emission. Besides this, a late point of time of closing of the exhaust valve reduces the induction work because less throttling is required for load regulation.

It can be said, in general, that the quantities of exhaust gas recirculated due to design-related valve overlaps in engines without a variable valve control are relatively small.

The technical world is further familiar with solutions in which an external exhaust gas recirculation is used. In this case, exhaust gas components are extracted at the exhaust manifold and returned to the intake manifold through complex pipe systems. In addition to the pipes, it is also necessary to provide return valves for the exhaust gas in these solutions.

OBJECTS OF THE INVENTION

It is an object of the invention to provide an internal combustion engine comprising a valve train of the pre-cited type in which a relatively widely "spread" internal exhaust gas recirculation is selectively enabled with simple measures.

This and other objects and advantages of the invention will become obvious from the following detailed description.

SUMMARY OF THE INVENTION

The invention achieves the above objects by the fact that the valve train itself is additionally designed for an internal exhaust gas recirculation at an exhaust valve, the housing comprises an inner and an outer element that are inter-inserted for relative axial displacement and can be coupled to each other through a coupling element for exhaust gas recirculation, the cam for each cam follower is a central high lift cam and at least one low lift cam is arranged axially adjacent the high lift cam, the high lift cam actuates the inner element of the housing comprising the running surface and the actuating surface, whereas the low lift cam contacts the outer element of the housing, the low lift cam being configured out-of-phase to the high lift cam, so that a lobe commencement of the low lift cam is situated in a section between an end of a run-off flank of the high lift cam and a commencement of a base circle of the high lift cam, while a lobe end of the low lift cam is situated before an end of the base circle of the high lift cam.

The aforesaid measures can be implemented in quite a simple manner because recourse can be had to already existing roller or bucket tappets of a type, known per se. By roller tappets are to be understood, tappets that actuate a tappet push rod in engines with bottom camshafts. If necessary, these measures can also be used on flat or mushroom-type tappets, or even on insert elements of finger levers or rocker arms. Another use of the invention relates to measures for fresh gas replenishment, in which case, the inventive valve train is implemented on intake valves.

Thus, in the case of a desired exhaust gas recirculation, the coupling element is loaded so as to connect the inner element of the housing to the outer element, so that the low lift cams of the camshaft are activated and their "after-lift" is transmitted through the cam follower to the gas exchange valve that is configured as an exhaust valve. The person skilled in the art will use calculation and designing methods with which he is familiar to determine the dimension of phase overlap of the low lift cam with the high lift cam as also for the determination of the lift curve of the low lift cam.

Thus, when no exhaust gas recirculation is desired, the valve train is a non-switchable valve train in which the outer element of the housing of the cam follower is displaceable relative to the inner element.

If need be, the aforesaid inventive measures can also be additionally used in a variable valve train.

According to a particularly advantageous feature of the invention, a hydraulic lash adjuster of a type, known per se, is installed in the cam follower. In this way, complex mechanical lash adjusting measures are dispensed with.

In contrast to switchable valve train elements like switchable roller tappets of a known construction, the inner element of the cam follower in the invention is contacted by a cam with a high (normal) lift, whereas the outer element is in contact with at least one low lift cam. Advantageously, however, the high lift cam is flanked by two low lift cams.

In a further advantageous embodiment of the invention, a contact surface of the outer element with the low lift cam has a cylindrical, for example convex, configuration in a direction of excursion of this low lift cam. In this way, cam followers of a smaller overall diameter can be created.

Due to the fact that, according to a further feature of the invention, the outer element of the housing is configured substantially in the form of a thin-walled bushing, a contribution is made towards realizing a light-weight construction. This bushing can be made, for instance, out of sheet metal by deep drawing. Suitable coupling elements are slides in the form of pistons or the like, known from the field of switchable cam followers. For the purpose of exhaust gas recirculation, coupling can be implemented on one or on both sides, but a coupling on both sides offers advantages with regard to tilting and force application.

According to a further advantageous feature of the invention, the slide constituting the coupling element is hydraulically displaced at least in one direction. In the opposite direction, it can likewise be displaced hydraulically or by the force of a mechanical spring such as a coil spring. Further conceivable displacement methods can be electromagnetic or magnetic loading at least in one direction of displacement.

According to still another feature of the invention, the inner element comprises an extension that is surrounded by a lost motion spring. This is globally a space-saving measure. If need be, this spring can also be disposed in the interior of the cam follower.

The invention will now be described more closely with reference to the appended drawing.

DETAILED DESCRIPTION OF THE DRAWING

Figure 1:
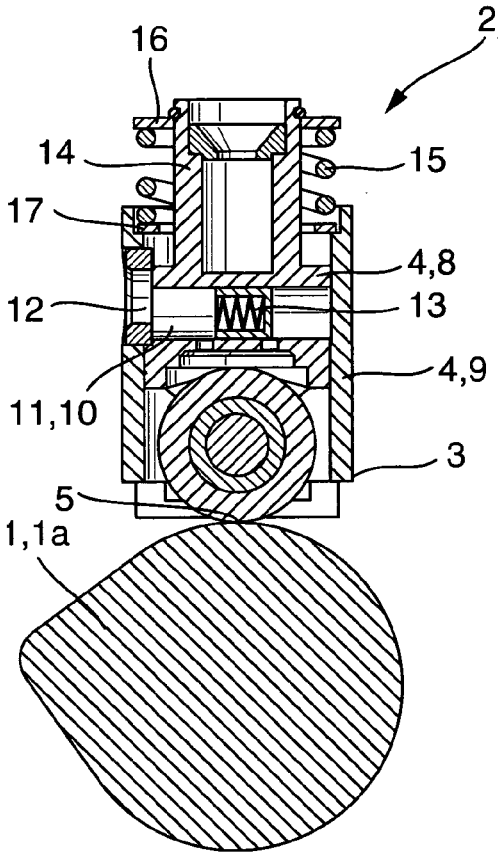
FIG. 1 shows a longitudinal section through a valve train of the invention including a cam follower and a high lift cam, a coupling element also being illustrated.

The figures disclose a valve train of an internal combustion engine that, besides opening an exhaust valve, is also used for internal exhaust gas recirculation. The figures illustrate a cam follower 2, in the present case a roller tappet, for actuating a tappet push rod through a housing 4. The latter comprises an outer element 9 of a thin-walled type that encloses an inner element 8 for relative axial displacement. In the region of one front end 3, the inner element 8 comprises a running surface 5 for a high lift cam 1*a* (see FIG. 1). In the present embodiment, this running surface 5 is constituted by a rolling-bearing mounted roller, but, if necessary, it can also be configured as a sliding surface. At a further front end 6, the inner element 8 comprises an actuating surface 7 that serves as a direct support for one end of a tappet push rod. In case of a direct actuation of a gas exchange valve, the end of the stem of this valve bears against this actuating surface 7.

If a hydraulic lash adjusting device is used, the actuating surface 7 can also be a part of a pressure piston of this device.

It can be further seen in FIG. 1 that the inner element 8 comprises a coupling element 10. This is configured in the present embodiment as a slide and is displaceable radially outward by the force of a spring 13. For coupling the inner element 8 to the outer element 9 for the purpose of internal exhaust gas recirculation (for further explanation, see introductory description and below), the slide 11 is displaced, in the absence of hydraulic medium pressure, by the force of the spring 13 into the then aligned recess 12.

Figure 2:
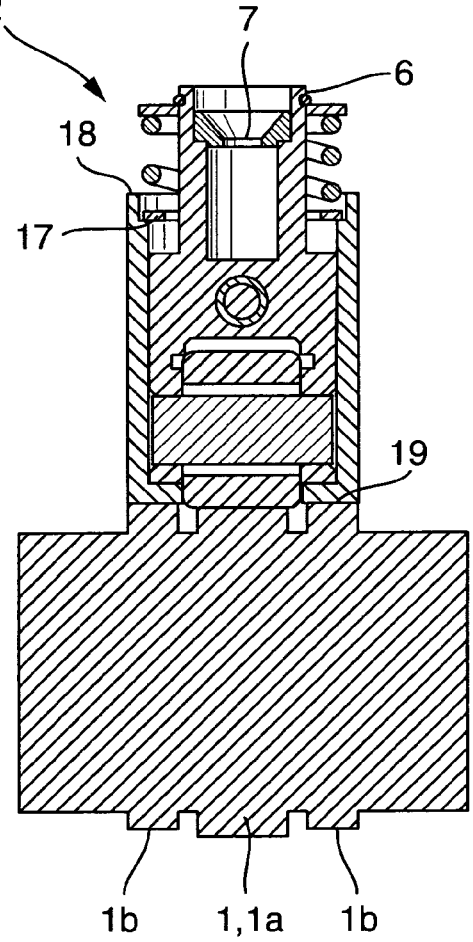
FIG. 2 shows a longitudinal section corresponding to FIG. 1, but turned through 90°.

Thereupon, the cam follower 2 does, of course, still generally follow the lift of the high lift cam 1*a* (see also FIG. 2), but due to the low lift cam 1*b* being arranged out-of-phase to the high lift cam 1*a*, a slight post-opening of the exhaust valve in the direction of the lift of the low lift cam 1*b* takes place. This is arranged with its cam tip so as to protrude slightly into the end of a run-off flank or into beginning base circle regions of the high lift cam 1*a*. In this way, through the once again partially recirculated exhaust gas, advantages with regard to consumption and emission (nitrogen oxides) can be assured.

It can be further seen in the figures that the inner element 8 extends with a dome-like extension 14 beyond an end face 18 of the outer element 9. A lost motion spring 15, known from the field of switchable valve train elements, extends around this dome-like extension 14. At its cam-distal end, this spring 15 bears against a support 16 of the extension 14 of the inner element 8. At its cam-proximate end, in contrast, the spring 15 acts against a support 17 in the region of the end face 18 of the outer element 9.

What is claimed is:

1. A valve train of an internal combustion engine comprising at least one cam and one directly driven cam follower, said cam follower comprising on one front end of a housing, a direct running surface for the cam, and on a further front end, an at least indirectly actuating surface for at least one gas exchange valve, wherein the valve train itself is additionally designed for an internal exhaust gas recirculation at an exhaust valve, the housing comprises an inner and an outer element that are inter-inserted for relative axial displacement and can be coupled to each other through a coupling element for exhaust gas recirculation, the cam for each cam follower is a central high lift cam and at least one low lift cam is arranged axially adjacent the high lift cam, the high lift cam actuates the inner element of the housing comprising the running surface and the actuating surface, whereas the low lift cam contacts the outer element of the housing, the low lift cam being configured out-of-phase to the high lift cam, so that a lobe commencement of the low lift cam is situated in a section between an end of a run-off flank of the high lift cam and a commencement of a base circle of the high lift cam, while a lobe end of the low lift cam is situated before an end of the base circle of the high lift cam.

2. A valve train of claim 1, wherein two low lift cams are arranged on a camshaft and enclose the high lift cam.

3. A valve train of claim 1, wherein the outer element of the housing is configured substantially in form of a thin-walled bushing, the inner element of the housing comprises the coupling element, said coupling element is configured as at least one slide that, for coupling, can be displaced in one of radial or secant direction into a complementary recess of the outer element.

4. A valve train of claim 3, wherein a displacement of the slide in one direction is effected by a hydraulic medium and, in an opposite direction, selectively by a force of at least one mechanical spring, typically a compression spring, or by a hydraulic medium.

5. A valve train of claim 3, wherein the inner element extends with an extension beyond the outer element, the further front end comprising the actuating surface is arranged on one end of the extension, the extension is surrounded by at least one lost motion spring that acts at one end against a support in a region of the further front end of the inner element and, at another end, against a support of the outer element in a portion of a cam-distal end face of the outer element.

6. A valve train of claim 1, wherein a contact surface of the outer element on the one front end is cylindrically curved in a direction of excursion of the at least one low lift cam.

7. A valve train of claim 1, wherein the cam follower comprises a hydraulic lash adjuster.

* * * * *